US008408418B2

(12) United States Patent
Kuzelka

(10) Patent No.: US 8,408,418 B2
(45) Date of Patent: Apr. 2, 2013

(54) DRUM COVER WITH CENTER SUPPORT

(75) Inventor: Kenneth J. Kuzelka, Island Lake, IL (US)

(73) Assignee: Michael D. Stolzman, Lake Forest, IL (US)

( * ) Notice: Subject to any disclaimer, the term of this patent is extended or adjusted under 35 U.S.C. 154(b) by 224 days.

(21) Appl. No.: 12/940,557

(22) Filed: Nov. 5, 2010

(65) Prior Publication Data

US 2012/0111864 A1 May 10, 2012

(51) Int. Cl.
*B01F 15/00* (2006.01)
*B65D 6/34* (2006.01)

(52) U.S. Cl. ..... 220/600; 220/608; 220/780; 220/601; 366/242; 366/247; 366/331; 366/347

(58) Field of Classification Search ..... 220/608, 220/288, 780, 792, 4.01; 366/139, 261, 347, 366/245, 249; 222/792
See application file for complete search history.

(56) References Cited

U.S. PATENT DOCUMENTS

| | | | | | |
|---|---|---|---|---|---|
| 975,342 | A * | 11/1910 | Firth | 220/610 |
| 1,182,466 | A * | 5/1916 | Ferguson | 220/309.2 |
| 1,344,457 | A * | 6/1920 | Schroeder | 220/288 |
| 1,771,321 | A * | 7/1930 | Snow | 366/263 |
| 2,151,146 | A * | 3/1939 | Petry | 366/331 |
| 2,648,344 | A * | 8/1953 | Randolph | 134/157 |
| 3,140,796 | A * | 7/1964 | Broida | 220/608 |
| 3,295,836 | A * | 1/1967 | Langella | 366/248 |
| 3,567,016 | A * | 3/1971 | Bardell | 206/427 |
| 3,946,897 | A * | 3/1976 | Wolff | 220/782 |
| 4,549,811 | A * | 10/1985 | Schiffner et al. | 366/129 |
| 4,818,114 | A * | 4/1989 | Ghavi | 366/130 |
| 4,961,647 | A * | 10/1990 | Coutts et al. | 366/139 |
| 5,094,543 | A * | 3/1992 | Mursa | 366/247 |
| 5,251,979 | A * | 10/1993 | Larsen | 366/248 |
| 5,292,024 | A * | 3/1994 | Koefelda et al. | 220/608 |
| 5,676,463 | A * | 10/1997 | Larsen | 366/251 |
| 5,875,915 | A * | 3/1999 | Bradshaw et al. | 220/319 |
| 5,971,189 | A * | 10/1999 | Baughman | 220/288 |
| 6,033,106 | A * | 3/2000 | Lesimple et al. | 366/198 |
| 7,318,668 | B2 * | 1/2008 | Bielozer | 366/331 |
| 8,029,183 | B2 * | 10/2011 | Berelsman et al. | 366/139 |
| 8,282,269 | B2 * | 10/2012 | Terentiev | 366/279 |
| 2008/0175095 | A1 * | 7/2008 | Mott et al. | 366/242 |
| 2010/0195432 | A1 * | 8/2010 | Laurence et al. | 366/139 |

* cited by examiner

*Primary Examiner* — Mickey Yu
*Assistant Examiner* — Gideon Weinerth
(74) *Attorney, Agent, or Firm* — Wood, Phillips, Katz, Clark & Mortimer

(57) ABSTRACT

A unitary cover is adapted for use with a tubular container having an open end with a cylindrical connecting bead at the open end. The unitary cover comprises a central circular wall. An annular flange is at a periphery of the central circular wall comprising a downwardly opening U-shaped channel receivable on the cylindrical connecting bead. A bung opening is provided through the central circular wall. A rib network depends downwardly from the central circular wall surrounding the bung opening.

18 Claims, 4 Drawing Sheets

DRUM COVER WITH CENTER SUPPORT

FIELD OF THE INVENTION

This invention relates to a drum cover and, more particularly, to a cover with center support for a mixer or the like.

BACKGROUND OF THE INVENTION

In one form of conventional shipping and storage container, a drum comprises a tubular container having an open end with a cylindrical connecting bead at the open end. The connecting bead may be provided by a metal connecting ring rolled onto the side wall or a plastic connecting ring molded directly to or otherwise adhered to the side wall. Alternatively, the side wall may be of molded plastic construction with an integral connecting bead.

The conventional drum includes a removable cover for closing the open end of the tubular side wall. A typical cover includes a central circular wall with a peripheral connecting flange receivable on the connecting bead so that the circular wall closes the open end of the container. A locking band secures the cover on the drum.

Occasionally a drum, such as a conventional 55 gallon drum, is used to carry liquid which must be mixed. An example is a liquid used for foam insulation. Such a drum could be formed of fiber, plastic, steel or composite construction. Typically, the cover is made from steel having a bung opening supporting a mixer including a motor that drives a mixing shaft and blade. The steel cover provides necessary strength to support weight of the mixer. Currently, a plastic cover is also used in such an application fitted with top and bottom steel flanges and a steel threaded adaptor to allow attachment of the mixer to the cover. The use of metal covers or plastic cover with metal flanges increases the cost and weight of the shipping container.

The present invention is directed to solving one or more of the problems discussed above in a novel and simple manner.

SUMMARY OF THE INVENTION

In accordance with the invention, there is provided a cover for use with a tubular container having a center support structure.

There is disclosed in accordance with one aspect of the invention a unitary cover for use with a tubular container having an open end with a cylindrical connecting bead at the open end. The unitary cover comprises a central circular wall. An annular flange is at a periphery of the central circular wall comprising a downwardly opening U-shaped channel receivable on the cylindrical connecting bead. A bung opening is provided through the central circular wall. A rib network depends downwardly from the central circular wall surrounding the bung opening.

It is a feature of the invention that the central circular wall is generally planar and has a raised support area surrounding the bung opening. The rib network extends radially beyond the raised support area.

It is another feature of the invention that the rib network comprises a threaded collar defining the bung opening. An annular rib is coaxial with the threaded collar. A plurality of radial ribs extend between the annular rib and the threaded collar. The central circular wall may be generally planar and has a raised support area surrounding the bung opening with a diameter of the support area being less than the diameter of the annular rib. The bottom edges of the ribs are coplanar.

It is a further feature of the invention to include a concentric ring extending downwardly from the annular flange and connecting the annular flange to the central circular wall. The radial ribs may extend from the threaded collar to the concentric ring. The bottom edges of the ribs and the concentric ring are coplanar.

It is another feature of the invention that the cover is of molded plastic construction.

There is disclosed in accordance with a further aspect of the invention a unitary plastic cover for use with a tubular container having an open end with a cylindrical connecting bead at the open end. The unitary cover comprises a central circular wall. An annular flange is at a periphery of the central circular wall comprising a downwardly opening U-shaped channel receivable on the cylindrical connecting bead. A bung opening is provided through the central circular wall. A rib network depends downwardly from the central circular wall surrounding the bung opening.

It is another feature of the invention that the central circular wall has a greater wall thickness than the rib network.

Further features and advantages of the invention will be readily apparent from the specification and from the drawings.

DETAILED DESCRIPTION OF THE INVENTION

Figure 1:
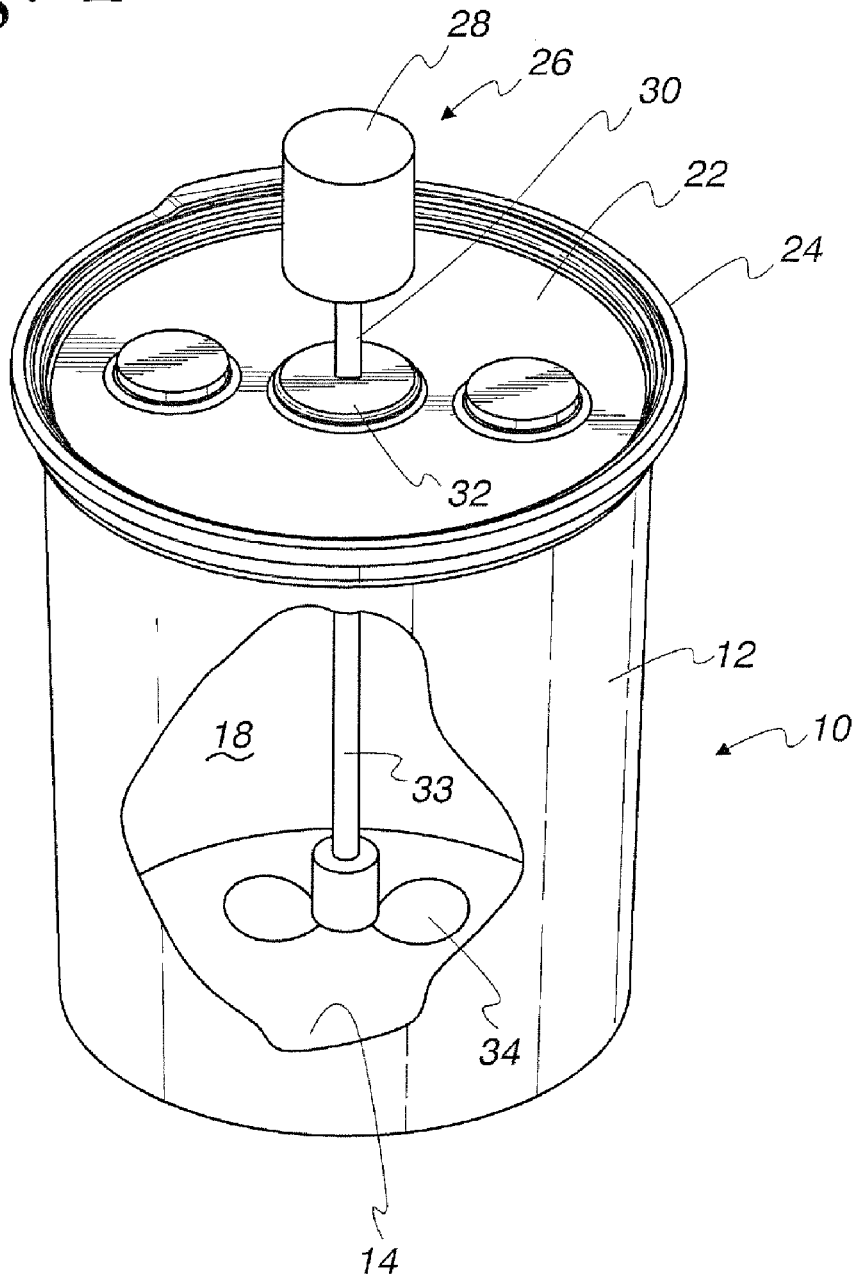
FIG. 1 is a perspective view of a container including a cover according to the invention supporting a mixer.
Figure 2:
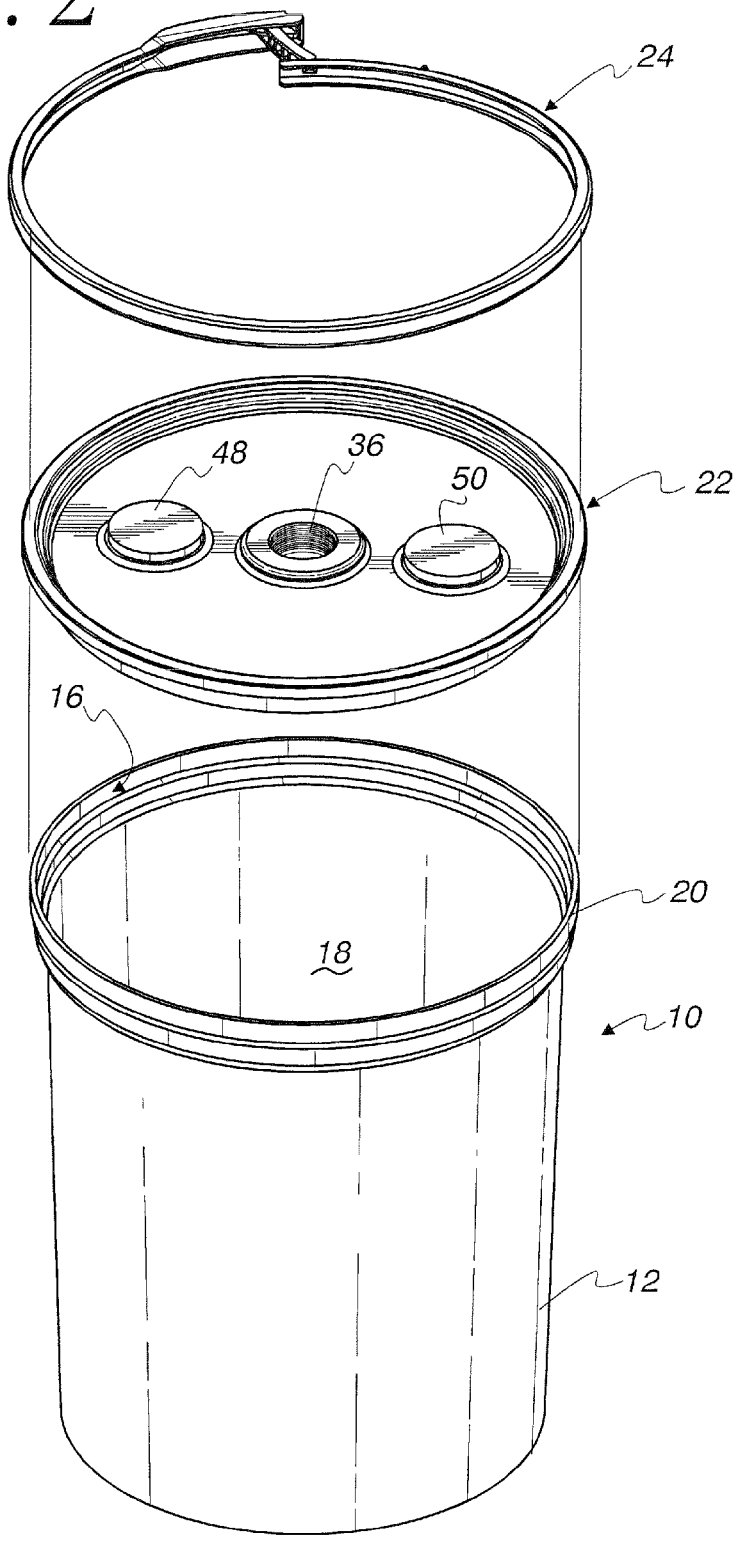
FIG. 2 is an exploded perspective view of the container of FIG. 1, without the mixer.
Figure 3:
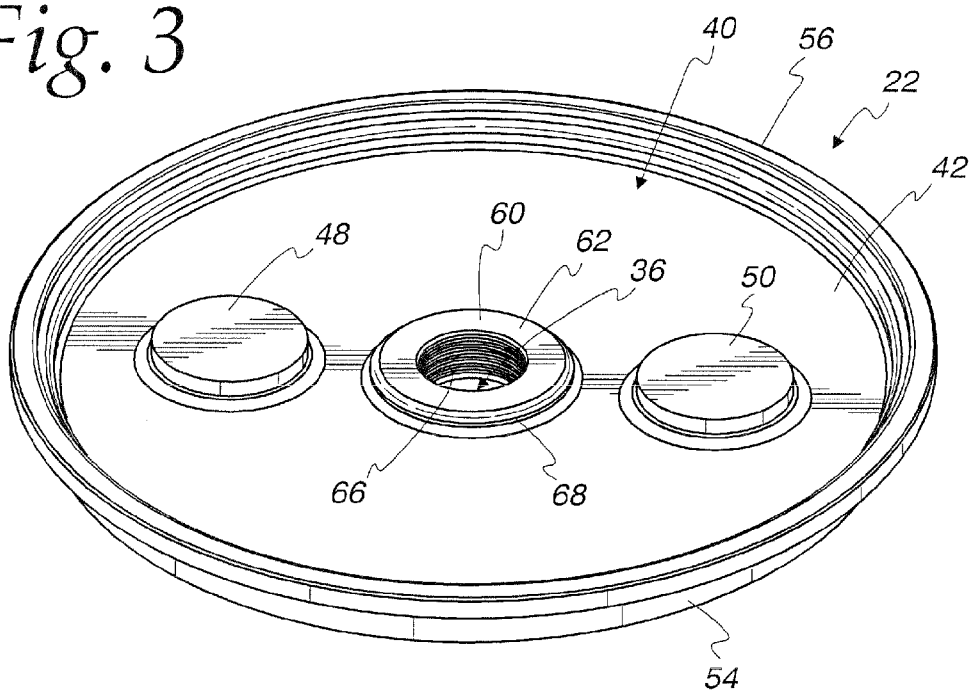
FIG. 3 is a top perspective view of the cover of FIG. 2.
Figure 4:
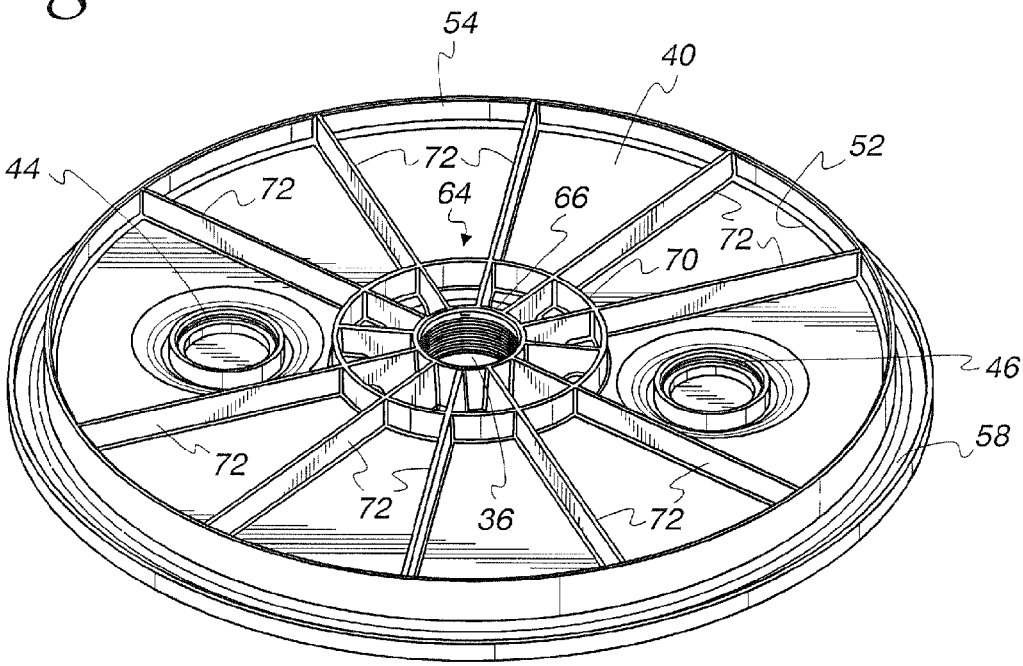
FIG. 4 is a bottom perspective view of the cover of FIG. 2.

In the illustrated embodiment of the invention, as disclosed in FIGS. 1 and 2, a shipping and storage container in the form of a drum 10 includes a tubular side wall 12 closed by a bottom wall 14 and having an open end 16 to define an interior space 18. A cylindrical connecting bead 20 is at the open end 16. The open end 16 is selectively closed by a closure in the form of a cover 22 in accordance with the invention. The cover 22 is removably secured to the connecting bead 20 with a locking band 24, in a conventional manner.

In the illustrated embodiment of the invention, the drum 10 comprises a cylindrical, blow-molded plastic drum. The drum may have a capacity in the range of about of 35 to 55 U.S. gallons and the connecting bead 20 has a diameter in the range of about 18" to 23". As is apparent, the dimensions of the drum 12 may vary. The present invention is directed particularly to the cover 22 which can be used with drums of other construction, such as metal, fiberboard, or composite construction, as will be apparent. Particularly, the cover 22 includes integrally formed structure enabling the cover to support a mixer 26. The mixer 26 may include, for example, a motor 28 having a cylindrical sleeve 30 connected to an adaptor 32. The sleeve 30 receives a shaft 33 for driving a blade 34. Particularly, the adaptor 32 is threaded to a center bung opening 36, see FIG. 2, so that the blade 34 is received in the enclosed space 18.

Referring to FIGS. 3-6, the cover 22 is illustrated in greater detail. The cover 22 comprises a unitary wall element of molded synthetic resin, such as high density polyethylene. The cover 22 includes a central circular wall 40. The central circular wall 40 is of a size corresponding to the container open end 16 and has a flat upper surface 42. A pair of conventional threaded bung fill openings 44 and 46 is provided in the circular wall 40 on opposite sides of the center bung opening 36. The fill openings 44 and 46 are closed by respective caps 48 and 50.

The circular wall 40 has a peripheral edge 52. A concentric ring 54 is radially outwardly of the peripheral edge 52 and extends above and below the circular wall 40, see FIG. 6. An annular peripheral flange 56 is connected atop the concentric ring 54. The peripheral flange 56 comprises a downwardly opening U-shaped channel 58 for receiving the connecting bead 20. A gasket (not shown) may be included in the channel 58 to provide a seal between the cover 22 and the drum 10.

As described, when the cover 22 is mounted to the drum 14, the connecting bead 20 is received in the channel 58, as is conventional. The locking band 24 sandwiches the peripheral flange 56, gasket and connecting bead 20 to retain the cover 22 on the drum 10 in a conventional manner.

In accordance with the invention, the cover 22 includes support structure 60 providing center support for the mixer 26. The structure 60 comprises a raised annular support area 62 surrounding the center bung opening 36 and a rib network 64 depending downwardly from the central circular wall 40 surrounding the bung opening 36.

The bung opening 36 is formed by a threaded collar 66 having a diameter of about 2". The annular support area 62 may be on the order of about 4" in diameter. The annular support area 62 includes a tapered edge 68 connecting with the flat upper surface 42.

Figure 5:
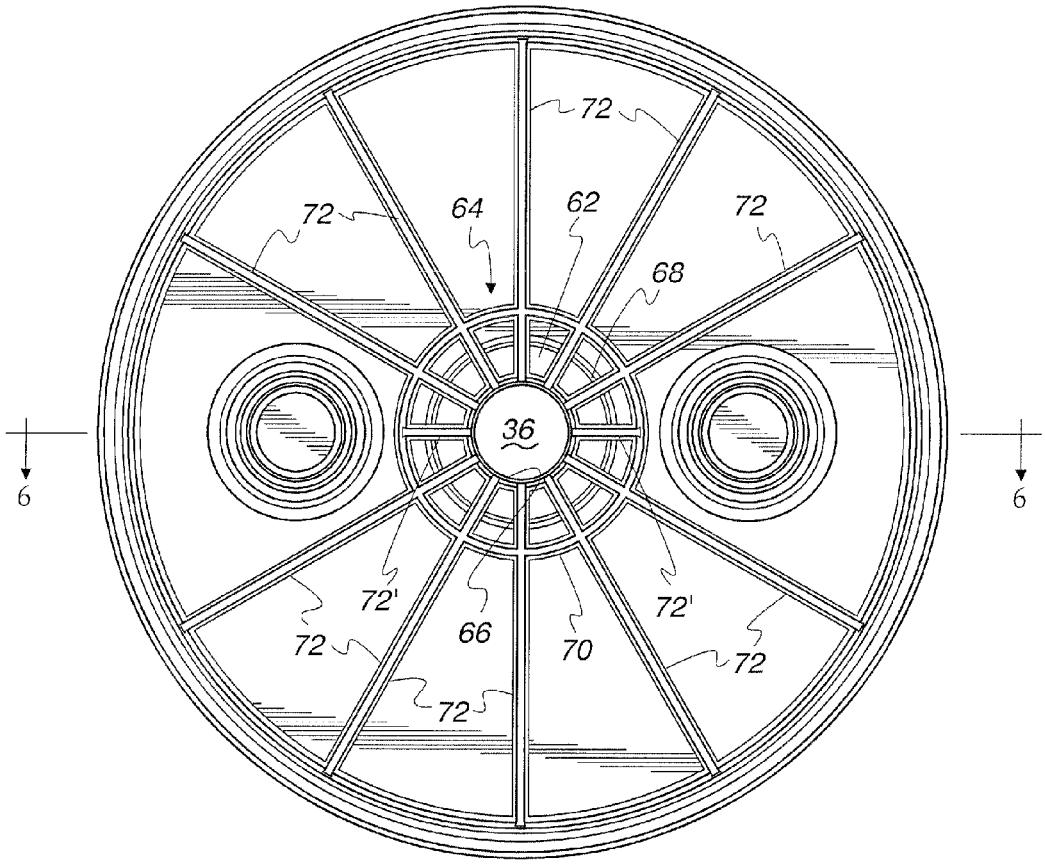
FIG. 5 is a bottom plan view of the cover of FIG. 2.
Figure 6:
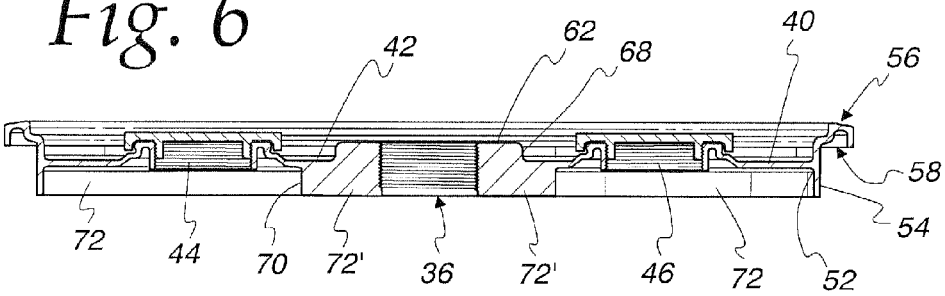
FIG. 6 is a cross sectional view taken along the line 6-6 of FIG. 5.

The rib network 64 comprises the threaded collar 66 and an annular rib 70 coaxial with the collar 66. The annular rib 66 has a diameter greater than the diameter of the annular support area 62, as is seen in FIGS. 5 and 6. A plurality of radial ribs 72 extend radially from the threaded collar 66 to the annular rib 70 and continue to the concentric ring 54, except for radial ribs 72' aligned with the fill openings 44 and 46 which end at the annular rib 70. Bottom edges of the threaded collar 66, annular rib 70, concentric ring 54 and radial ribs 77 and 72' are coplanar.

The radial ribs 72 and 72' increase in height between the annular rib 70 and the threaded collar 66 owing to the higher elevation of the annular support 62, as is apparent in FIG. 6. As such, portions of the radial ribs 72 and 72' extend above the circular wall 40 to provide enhanced support. The radial ribs 72, radially outwardly of the annular ribs 70, transfer weight loads to the outer ring 54. The raised height of the annular support area 62 provides an extended depth thread engagement of the threaded collar 66 for receiving the mixer adaptor 32. Also, the outer concentric ring 54 is adapted to come in contact with the inside of the drum wall 12 to provide transfer of forces to the drum wall 12.

In accordance with the invention, the cover 22 is provided with the central circular wall 40 and annular support area 62 having uniform wall thickness of about 150 mil. The rib network 64 is formed with the ribs having common thickness on the order of 110 to 120 mil. As such, the ribs are of lesser thickness than the wall. The height of the ribs is about 1" except in areas below the raised central support 62. The drum cover 22 is formed such as by injection molding of plastic and results in a weight on the order of about 3 lbs. This compares to a metal cover which weighs about 7 lbs. The raised annular support area 62 along with the rib network 64 adds strength at the central point for supporting the mixer 26.

While the support structure 60 is illustrated in the center of the cover 22, the support structure could be provided off center, as is apparent.

Thus, in accordance with the invention, there is provided a unitary cover including support structure for supporting a mixer or the like.

I claim:

1. A unitary cover for use with a tubular container having an open end with a cylindrical connecting bead at the open end, the unitary cover comprising:

a central circular wall, an annular flange at a periphery of the central circular wall comprising a downwardly opening U-shaped channel receivable on the cylindrical connecting bead, a bung opening through the central circular wall, and a rib network depending downwardly from the central circular wall surrounding the bung opening, wherein the rib network comprises a threaded collar defining the bung opening, an annular rib coaxial with the threaded collar and a plurality of radial ribs extending between the annular rib and the threaded collar.

2. The unitary cover of claim 1 wherein the central circular wall is generally planar and has a raised support area surrounding the bung opening.

3. The unitary cover of claim 2 wherein the rib network extends radially beyond the raised support area.

4. The unitary cover of claim 1 wherein the central circular wall is generally planar and has a raised support area surrounding the bung opening with a diameter of the support area being less than a diameter of the annular rib.

5. The unitary cover of claim 4 wherein bottom edges of the ribs are coplanar.

6. The unitary cover of claim 4 further comprising a concentric ring extending downwardly from the annular flange and connecting the annular flange to the central circular wall.

7. The unitary cover of claim 6 wherein the radial ribs extend from the threaded collar to the concentric ring.

8. The unitary cover of claim 7 wherein bottom edges of the ribs and the concentric ring are coplanar.

9. The unitary cover of claim 1 wherein the cover is of molded plastic construction.

10. A unitary plastic cover for use with a tubular container having an open end with a cylindrical connecting bead at the open end, the unitary cover comprising:

a central circular wall, an annular flange at a periphery of the central circular wall comprising a downwardly opening U-shaped channel receivable on the cylindrical connecting bead, a bung opening through the central circular wall, and a rib network depending downwardly from the central circular wall surrounding the bung opening, wherein the rib network comprises a threaded collar defining the bung opening, an annular rib coaxial with the threaded collar and a plurality of radial ribs extending between the annular rib and the threaded collar.

11. The plastic unitary cover of claim 10 wherein the central circular wall is generally planar and has a raised support area surrounding the bung opening.

12. The plastic unitary cover of claim 11 wherein the rib network extends radially beyond the raised support area.

13. The plastic unitary cover of claim 10 wherein the central circular wall is generally planar and has a raised support area surrounding the bung opening with a diameter of the support area being less than a diameter of the annular rib.

14. The plastic unitary cover of claim 13 wherein bottom edges of the ribs are coplanar.

15. The plastic unitary cover of claim 13 further comprising a concentric ring extending downwardly from the annular flange and connecting the annular flange to the central circular wall.

16. The plastic unitary cover of claim 15 wherein the radial ribs extend from the threaded collar to the concentric ring.

17. The plastic unitary cover of claim 16 wherein bottom edges of the ribs and the concentric ring are coplanar.

18. The plastic unitary cover of claim 10 wherein the central circular wall has a greater wall thickness than the rib network.

* * * * *